United States Patent [19]

Reaves et al.

[11] Patent Number: 5,009,326

[45] Date of Patent: Apr. 23, 1991

[54] INSULATED CONTAINER SYSTEM FOR SHIPPING PERISHABLE PRODUCTS

[75] Inventors: Thomas A. Reaves; John S. Sherritt, both of Anchorage, Ak.

[73] Assignee: Premier Industries, Inc., Tacoma, Wash.

[21] Appl. No.: 554,183

[22] Filed: Jul. 18, 1990

Related U.S. Application Data

[63] Continuation of Ser. No. 325,677, Mar. 17, 1989, abandoned.

[51] Int. Cl.[5] ..... B65D 77/00

[52] U.S. Cl. ..... 220/441; 220/410; 206/450

[58] Field of Search ..... 220/441, 410, 403, 3.1, 220/470, 62, 408; 206/522, 450; 229/905

[56] References Cited

U.S. PATENT DOCUMENTS

| | | | |
|---|---|---|---|
| 1,343,391 | 6/1920 | Haas | 220/410 |
| 2,006,705 | 7/1935 | Bangs | 220/410 X |
| 2,632,311 | 3/1953 | Sullivan | 220/410 X |
| 3,121,522 | 2/1964 | Ragnow | 220/441 X |
| 3,140,037 | 7/1964 | Baum et al. | 229/186 X |
| 3,172,593 | 3/1965 | Potter | 220/3.1 X |
| 3,344,973 | 10/1967 | Studen | 220/441 X |
| 3,465,948 | 9/1969 | Boyer | 220/410 X |
| 3,890,762 | 6/1975 | Ernst et al. | 220/441 X |
| 3,987,956 | 10/1976 | Congleton | 206/523 X |
| 4,730,748 | 3/1988 | Bane | 220/441 X |
| 4,889,252 | 12/1989 | Rockom et al. | 220/3.1 |
| 4,928,847 | 5/1990 | Hollander et al. | 206/450 X |

*Primary Examiner*—Steven M. Pollard

*Attorney, Agent, or Firm*—Christensen, O'Connor, Johnson & Kindness

[57] ABSTRACT

An insulated container for shipping perishable products is provided. An insulated container system (10) includes a telescoping container having a top (14) and a bottom (16). The top (14) and bottom (16) are each formed from a rectangular sheet (28) of corrugated cardboard. The sheet (28) is coated with wax to repel moisture. The sheet (28) is folded inwardly to form corners (41A–41D). Inwardly folded sections (44, 46, 48, and 50) form multilayered, triangular regions of side walls (38A and 38B). Single layered central side wall portions (52A and 52B) between the multilayered regions are trapezoidal. A one-piece insulating liner (18) is formed by folding a sheet (58) of expanded polystyrene along creases. The one-piece insulating liner (18) has trapezoidal side walls (62A and 62B) and rectangular end walls (60A and 60B) that form an integral structure with a floor (64). The one-piece insulating liner (18) is inserted into the bottom (16) and covers single layered portions of the bottom (16). An insulating lid (20) covers a ceiling of the top (14). An optional liner (22) and an absorbent pad may be used to protect the one-piece insulating liner (18) and the insulating lid (20) from moisture.

17 Claims, 3 Drawing Sheets

INSULATED CONTAINER SYSTEM FOR SHIPPING PERISHABLE PRODUCTS

This application is a continuation application based on prior copending application Ser. No. 07/325,677, filed on Mar. 17, 1989 now abandoned.

FIELD OF THE INVENTION

This invention relates to containers, and more particularly, to insulated shipping containers.

BACKGROUND OF THE INVENTION

There are many ways that a product supplier may ship a product to a customer. For example, the supplier may ship the product by truck, train, ship, or airplane. Factors such as shipping distance, allowable transit time of the product, the nature of the product being shipped, and the cost of shipping the product affect the supplier's decision as to which shipping method to use. Some of these factors are not readily controllable by the supplier. For example, the distance between the supplier and a customer is relatively fixed, unless, of course, one of the parties changes location. The nature of the product is also relatively fixed. The nature of the product may determine the allowable transit time or how the product must be packaged for shipment. For example, if the supplier is shipping perishable products, the allowable transit time may be significantly less than for nonperishable products. Furthermore, a perishable product may require special packaging or shipping considerations, such as insulated containers or refrigeration. Another factor that is not entirely within the control of the supplier is the cost of shipping the product. While the supplier may choose the method of shipment that is to be used, the supplier must pay a rate that is set by a shipping merchant.

One factor that the supplier exercises a certain amount of control over is the allowable transit time of the product. In the case of perishable products, the allowable transit time becomes the time the supplier has to deliver the product before it spoils. The allowable transit time of certain perishable products, such as food for example, may be extended by freezing the product and shipping the product in a frozen condition. However, not all types of perishable food products can be shipped frozen. A customer may request that a perishable product, such as fresh seafood, not be frozen for shipment. In any event, whether or not the perishable product is frozen, the allowable transit time of the product may be increased if the product is protected from the potentially harmful effects of heat. One way to protect the perishable product from heat is to ship it in a refrigerated vault, such as in a refrigerated truck or refrigerated train car. However, refrigerated shipping usually increases the supplier's cost of shipping the product.

Another way to increase the allowable transit time of a perishable product is by packaging the product in an insulated container and shipping it in the insulated container. An insulated container, like a refrigerated vault, protects the product from the potentially harmful effects of heat. Insulated containers, such as insulated boxes, are commonly used to ship perishable products. Prior art insulated boxes are usually constructed of multiple layers of corrugated cardboard. This type of insulated container usually has a "box within a box" type of construction or a single box type of construction with multiple-layered walls. Insulated boxes of this sort achieve their insulating characteristics from dead air spaces within the corrugated cardboard used to construct the boxes.

Insulated cardboard boxes are popular in the shipping industry because they are inexpensive and relatively light weight. As a result, these insulated cardboard boxes help keep down shipping costs. Unfortunately, insulated cardboard boxes that rely solely upon the dead air spaces in the corrugated cardboard to achieve their insulating capability lose some of their insulating capacity when they become wet or when the cardboard is punctured. Wet cardboard conducts heat better than dry cardboard and allows the heat outside the box to warm the dead air in the spaces within the corrugated cardboard and, hence, warm up the product within the box. Any time the cardboard is punctured, such as with a knife or by a blow incurred during shipping, the insulating ability of the punctured dead air spaces are reduced. Unfortunately corrugated cardboard is easily punctured. In any event, with this type of insulated cardboard box, the wet or punctured cardboard reduces the allowable transit time of the product.

Another type of insulated container that has been successfully used in the prior art is made from a cardboard box and individual pieces of insulating material, such as styrofoam or other lightweight foam type of insulation. Usually, this type of insulated container is constructed by gluing the individual pieces of the insulating foam material to the interior surfaces of the cardboard box or by inserting separate foam pieces to insulate each container surface. This type of insulated container offers certain advantages over insulated containers made solely from corrugated cardboard. The foam type of insulating material generally has better insulating characteristics than single or multiple layers of corrugated cardboard. Additionally, foam type insulating materials are less affected by moisture than is cardboard. Typically, the foam pieces that are glued to the cardboard box, or inserted into the container, are thicker than the skin of the corrugated cardboard and, as a result, are more resistant to puncture than simple cardboard box construction. Furthermore, dead air spaces in the foam insulating material are smaller and more numerous than in corrugated cardboard and, as a result, the insulating ability of the foam material is less affected by small punctures. However, cutting the individual pieces of insulating foam and gluing them to the surfaces of a cardboard box or adding six separate foam panels to the container, requires a substantial amount of assembly time. Accordingly, this type of insulated container is usually more expensive to assemble than other types of insulated containers and, thereby, result in increased shipping costs.

An additional type of insulated container that has been successfully used in the prior art is made from form molded foam. Typically this type of insulated container is made from either expanded or extruded polystyrene and the foam provides the dimensional structure of the container as well as providing the insulative barrier. In some, but not all cases, an additional corrugated sleeve or telescoping box is used into which the form molded container is inserted to provide additional structural support. This type of insulated container provides the advantage of ease of assembly but requires a substantial amount of floor space and cubic volume to store and transport. Furthermore, this type of container results in an inordinately high freight cost in shipping the container from the manufacturing center or distribution center to the end user's operating location.

As can be readily appreciated from the foregoing discussion, there is a need for an affordable insulated shipping container, suitable for shipping perishable products, that is lightweight, easy to assemble, and moisture resistant. Additionally, such a container should require very little storage space when not being used for shipping. This invention is directed to an insulated container system that uses inexpensive cardboard box construction and a one-piece insulating foam liner to achieve these results.

SUMMARY OF THE INVENTION

In accordance with the present invention, an insulated container system for shipping perishable products is provided. The container system comprises: an outer container; a one-piece insulating liner; and, an insulating lid. The outer container includes a top and bottom. Preferably, the top and bottom of the outer container are each constructed from a sheet of container material, such as corrugated cardboard. Each of the sheets is folded to form a box having a rectangular floor or ceiling encompassed by side walls and end walls. Regardless of how formed, at least the bottom of the container has side and/or end walls portions composed of a single layer of the container material. The one-piece insulating liner is folded so as to cover the floor and the single layer portions of the side and/or end walls when the one-piece insulating liner is inserted into the bottom of the outer container. The insulating lid covers the ceiling of the top when the insulating lid is inserted into the top of the outer container.

In accordance with further aspects of the invention, the corners of the top and bottom of the outer container are formed by inwardly folded sections of a rectangular sheet. The inwardly folded sections are fastened to the side and/or end walls of the top and bottom of the outer container, resulting in the creation of triangular shaped multilayered regions. The one-piece insulating liner has trapezoidal sections that overlie single layered side and/or end wall regions and mate with the triangular shaped multilayer regions of the bottom of the outer container.

In accordance with still further aspects of this invention, a one-piece insulating liner to be inserted into a shipping container is provided. The one-piece insulating liner comprises: a rectangular floor; two side walls; and two end walls. The side walls and end walls form an integral structure with the floor. The one-piece insulating liner is formed from a sheet of foam insulating material and contains creases where the side and end walls join the floor. Preferably, the end walls are rectangular and the side walls are trapezoidally shaped. The trapezoidal side walls are oriented such that the long edge of the trapezoid joins the floor.

As will be appreciated from the foregoing summary, the invention provides an insulated container system suitable for shipping perishable products that includes an outer container having a top and a bottom, a one-piece insulating liner, and a separate insulating lid.

BRIEF DESCRIPTION OF THE DRAWINGS

The foregoing and other features and advantages of the present invention will become better understood by reference to the following detailed description when taken in conjunction with the accompanying drawings, wherein.

DESCRIPTION OF THE PREFERRED EMBODIMENT

There is a need for an insulated container that is suitable for shipping perishable products, which is constructed from inexpensive, lightweight materials that are easy to assemble. Desirably, the insulated container should require minimal storage space when not assembled. The insulated container system illustrated in FIG. 1 and formed in accordance with this invention accomplishes these results.

Figure 1:
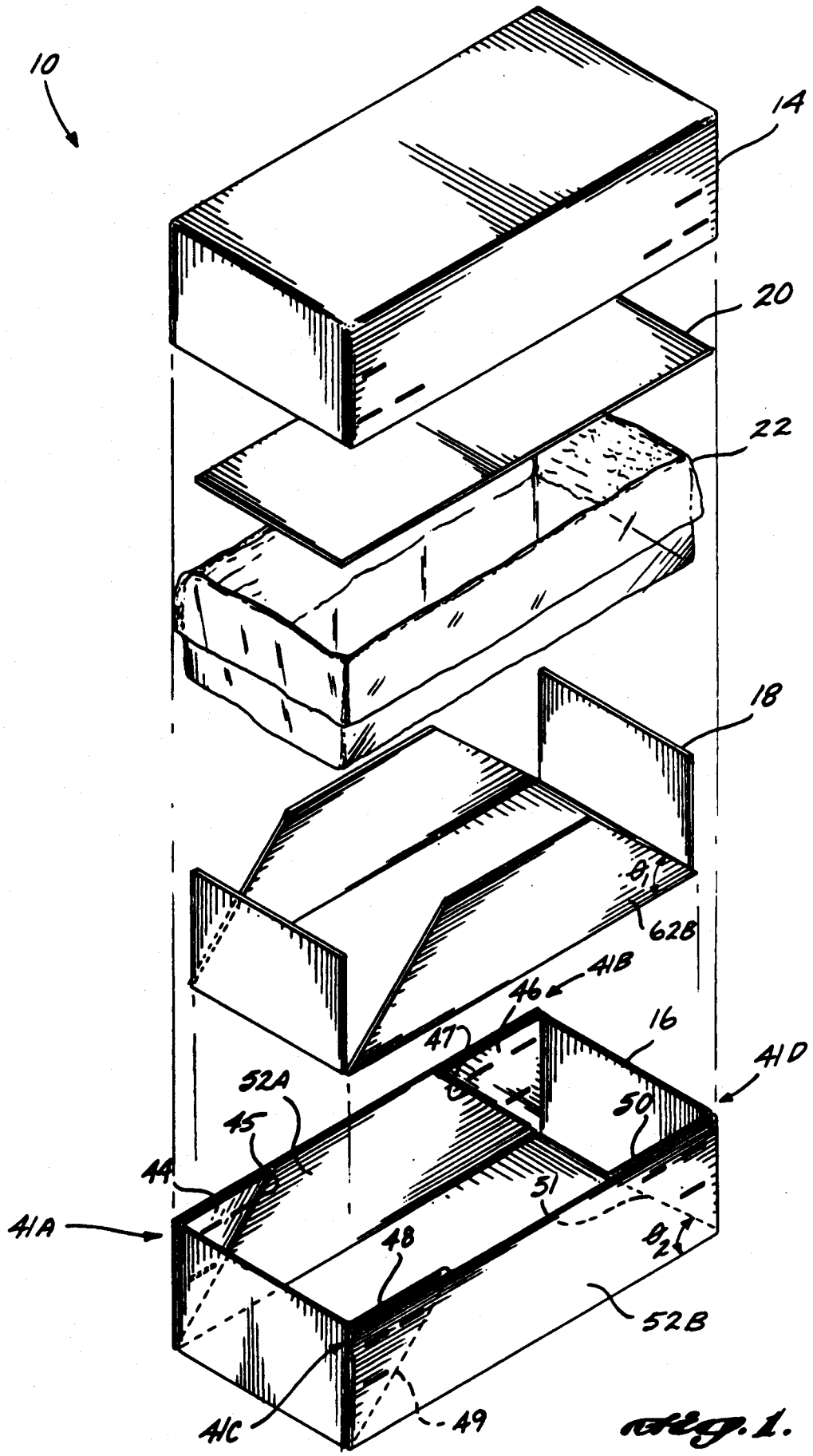
FIG. 1 is an exploded view of a preferred embodiment of an insulated container system formed in accordance with the present invention.

FIG. 1 is an exploded view of the presently preferred embodiment of an insulated container system 10 formed in accordance with the invention. The illustrated insulated container system 10 comprises: a top 14; a bottom 16; a one-piece insulating liner 18; and, an insulating lid 20. The container system 10 also includes an optional polyethylene liner 22 and an optional absorbent pad (not shown).

The top 14 and bottom 16 form an outer container or box, preferably, a telescoping container, sized such that the bottom 16 may be received into the top 14. When assembled, the telescoping container preferably forms a right rectangular parallelepiped. It is to be understood that the outer container is not limited to a telescoping container type of assembly, nor is the assembled container limited to the shape of a right rectangular parallelepiped. The top 14 and bottom 16 are made from sturdy, inexpensive container material, such as corrugated cardboard. More specifically, as will become better understood from the following discussion, preferably, the top 14 and bottom 16 are each formed from a sheet of corrugated cardboard that does not contain any flaps or cutouts. Rather the sheet has a simple rectangular shape. The corrugated cardboard sheet is coated with wax or other moisture repellent substance to increase the moisture repellency of the telescoping container. As will also become better understood from the following discussion, as shown in FIG. 1, the rectangular sheets of cardboard are folded to form the top 14 and bottom 16. When folded, triangular areas, or gussets, are located near the corners of both the top 14 and bottom 16 that consist of multiple layers of the corrugated cardboard sheet.

As will also become more fully understood from the following discussion, the one-piece insulating liner 18 is formed from a single sheet of foam insulating material, such as expanded polystyrene, for example. In one actual embodiment of the invention, polystyrene having a thickness of ⅜ inch and a density in the range of 1.5–2 pounds per cubic foot is used to form the sheet of insulating material. The one-piece insulating liner 18 has a floor with integral end and side walls that are formed by folding the sheet along creases that define the floor. The one-piece insulating liner 18 is cut and folded so that it mates with the single layer portions of the bottom 16. The insulating lid 20 may be made of the same insulating material as the one-piece insulating liner 18. The insulating lid 20 has a rectangular shape and is sized to mate with the ceiling of the top 14.

The insulated container system 10 may be assembled in the following manner. After the rectangular cardboard sheets have been folded to form the top 14 and bottom 16, the insulating liner 18 is inserted into the bottom 16. The polyethylene liner 22, if used, is placed over the insulating liner 18 so that it lines the exposed, inside surfaces of the insulating liner 18. A perishable product, such as fresh or frozen seafood, for example, may then be placed within the partially assembled insulated container system 10. The insulating lid 20 is then placed over the perishable products. If used, the absorbent pad (not shown) may be placed between the perishable product and the insulating lid 20. The top 14 is placed over insulating lid 20 to complete the assembly of the insulated container system 10.

Folding rectangular cardboard sheets to form the top and bottom of a telescoping container is well known in the container art. This type of construction is discussed below to allow various important features of the present invention to become better understood. More specifically, construction of the bottom 16 is discussed so that the mating between the one-piece insulating liner 18 and the single layer portions of the bottom 16 will be better understood. While not discussed below, preferably, the top 14 is constructed in a substantially identical manner.

Figure 2:
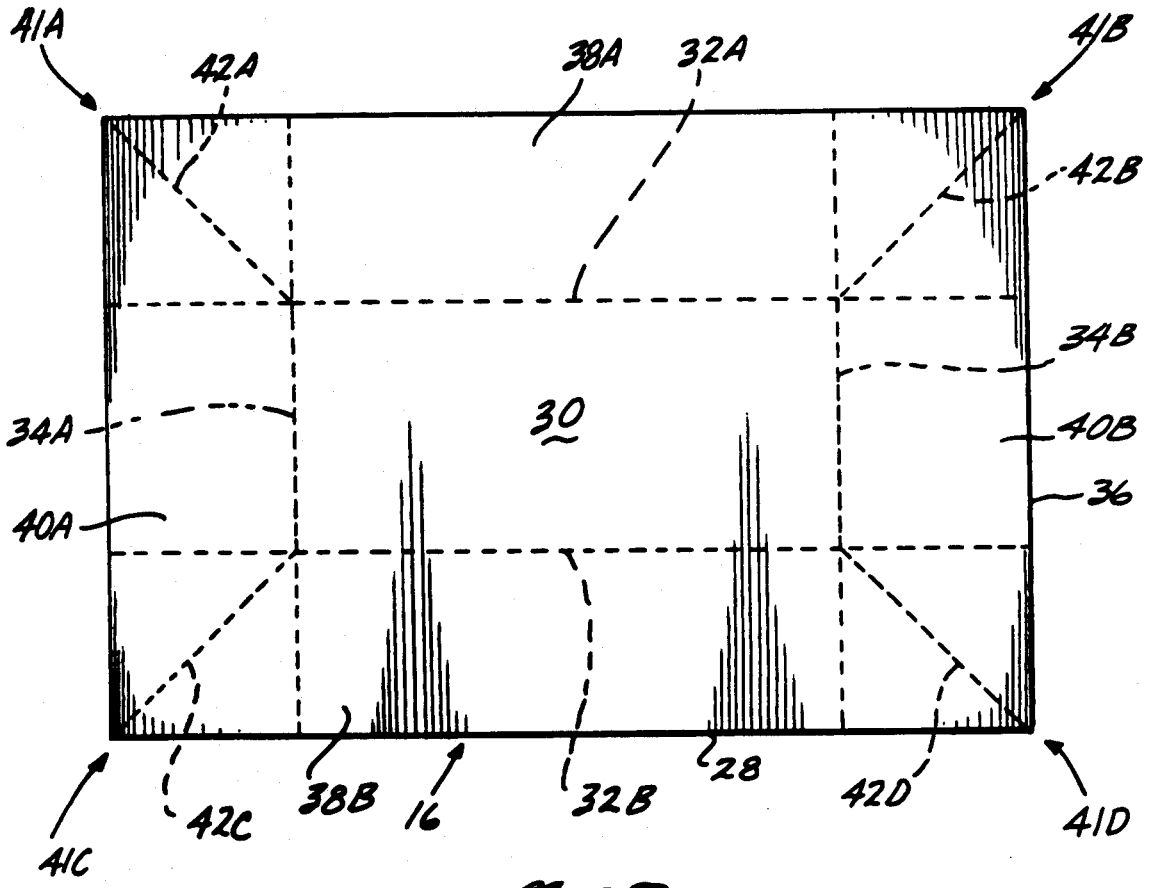
FIG. 2 is a plan view of a rectangular sheet of cardboard suitable for forming the bottom of a telescoping container of the type depicted in FIG. 1.

FIG. 2 illustrates a rectangular sheet 28 of corrugated cardboard suitable for forming the bottom 16. As noted above, preferably, the sheet 28 is coated with wax or other water repellent substance to increase the moisture repellency of the cardboard. As FIG. 2 illustrates, the rectangular sheet 28 does not have any flaps or cutouts that typically appear when other forms of cardboard containers are laid out flat. The absence of flaps and cutouts results in the creation of container tops and bottoms having no seams or gaps. Further, such containers are easily formed at the time when they are needed without the benefit of glue or tape. When stapled in the manner described below they are very rigid.

As shown by dashed lines in FIG. 2, the bottom 16 includes: a rectangular floor 30; two rectangular side walls 38A and 38B; and, two rectangular end walls 40A and 40B. The edges of the floor 30 are defined by a pair of side lines 32A and 32B and a pair of end lines 34A and 34B located orthogonal to the side lines. The floor is located in the center of the bottom and the side and end lines lie parallel to adjacent edges of the bottom. Further, the side and end lines are equispaced from their respective adjacent edges of the bottom 16.

The side walls 38A and 38B are formed by upwardly folding the sheet 28 along side lines 32A and 38B, respectively. The end walls 40A and 40B are formed by upwardly folding the sheet 28 along end lines 34A and 34B, respectively. As the side and end walls are folded upwardly, the junctions therebetween are folded inwardly to form corners 41A, 41B, 41C, and 41D. More specifically, the corner 41A is formed at the juncture of side wall 38A and end wall 40A by inwardly folding the sheet 28 along a 45° diagonal line 42A. An inwardly folded section 44, commonly referred to as a gusset, is thereby formed. As best shown in FIG. 1, the inwardly folded section 44 is triangular and is composed of two layers of the sheet 28. Further, the inwardly folded section 44 has an inclined side 45 that is formed by the fold along line 42A. The inwardly folded section 44 is fastened to the side wall 38A, preferably by staples. The remaining corners are formed in a similar manner. More specifically, the corner 41B is formed at the juncture of side wall 38A and end wall 40B. The folded corner 41B creates an inwardly folded section 46 composed of two triangular layers of the sheet 28. The inwardly folded section 46 has an inclined side 47 formed by the fold along line 41B and is stapled to the side wall 38A. The corner 41C is formed at the juncture of side wall 38B and end wall 40A. The folded corner 41C creates an inwardly folded section 48 composed of two layers of the sheet 28. The inwardly folded section 48 is triangular, has an inclined side 49 formed by the fold along line 41C, and is fastened to the side wall 38A. The corner 41D is formed at the juncture of side wall 38B and end wall 40B. The folded corner 41D creates an inwardly folded section 50 composed of two triangular layers of the sheet 28. As with the other corners, the sheets are fastened to a side wall 38B, preferably by staples. The inwardly folded section 50 has an inclined side 51 formed by the fold along line 42D.

As illustrated in FIG. 1, the floor 30 and end walls 34A and 34B are made of a single layer of the sheet 28. The inwardly folded sections 44, 46, 48, and 50 and the abutting side walls 38A and 38B form multilayered regions of the bottom 16. As noted above, the multilayered regions are triangular in shape. The multilayered regions do not extend the entire length of the side walls 38A and 38B. Rather, single layer central side wall portions 52A and 52B lie between the multilayered regions. More specifically, the central side wall portion 52A forms a portion of the side wall 38A between the inwardly folded sections 44 and 46. Likewise, the central side wall portion 52B forms a portion of the side wall 38B between the inwardly folded sections 48 and 50. Since the multilayered regions are spaced apart and have a triangular shape, the central side wall portions 52A and 52B have a trapezoidal shape. More particularly, the central side wall portions 52A and 52B are regular trapezoids with inclined sides of equal length. The inclined sides of the central side wall portion 52A are defined by the inclined sides 45 and 47 of the inwardly folded sections 44 and 46. The inclined sides of the central side wall portion 52B are defined by the inclined sides 49 and 51 of the inwardly folded sections 48 and 50.

Figure 3:
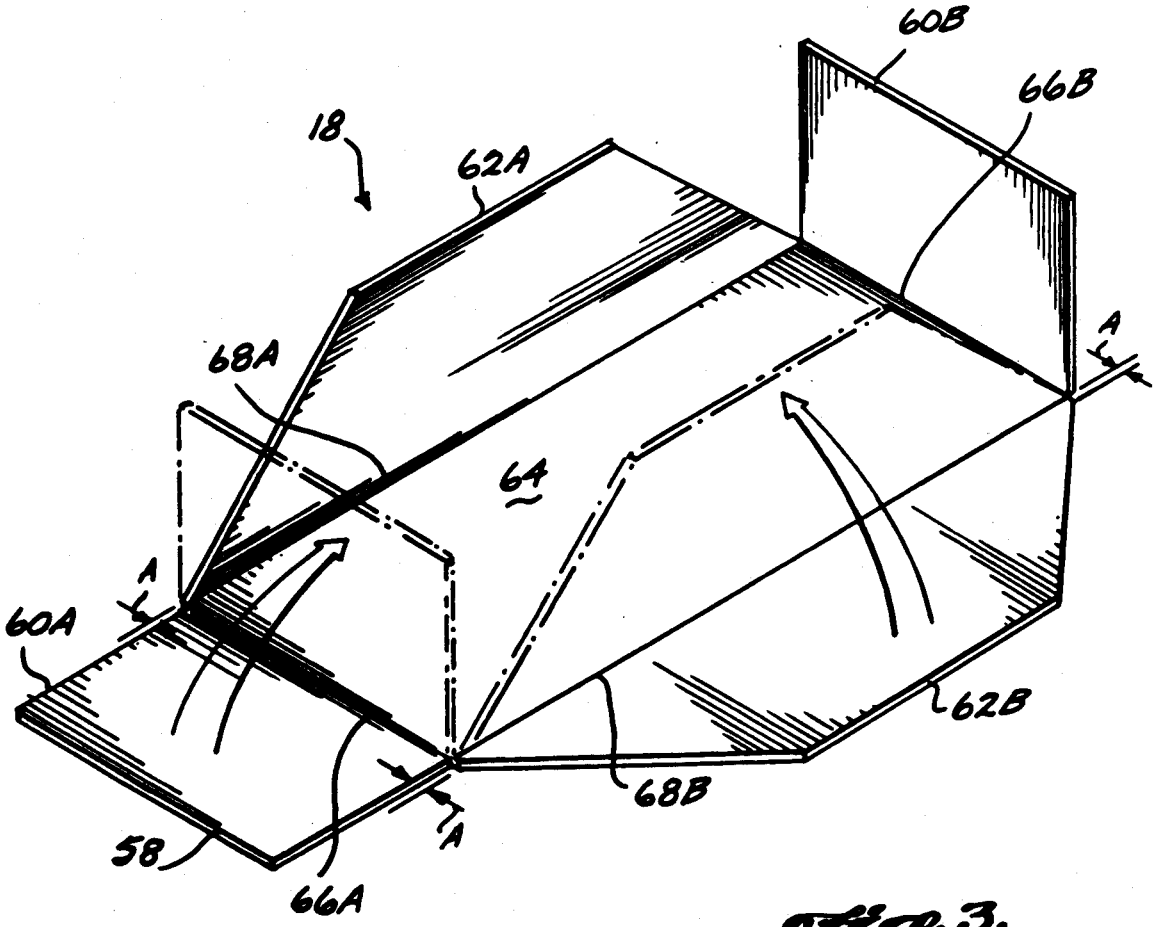
FIG. 3 is an isometric view of a one-piece insulating liner suitable for use in the bottom of the telescoping container depicted in FIG. 1; and, FIG. 4 is a side section of the assembled insulated container system depicted in FIG. 1.

As shown in FIG. 3, the one-piece insulating liner 18 is formed from a sheet 58 made of a foam insulating material. As previously noted, a suitable type of foam insulating material for the one-piece liner 18 is expanded polystyrene. Other insulating materials that are lightweight and sufficiently rigid may also be used. As will become better understood from the following discussion, a sheet 28, cut into the proper shape, is folded to form the one-piece insulating liner 18.

The one-piece insulating liner 18 comprises: a rectangular floor 64; two rectangular end walls 60A and 60B; and, two trapezoidal side walls 62A and 62B. The floor 64, the end walls 60A and 60B, and side walls 62A and 62B form an integral structure. The four sides of the rectangular floor 64 are defined by end lines 66A and 66B and side lines 68A and 68B. The floor 64 also has an overall length that is slightly less than the distance between the end walls 40A and 40B of the bottom 16 and an overall width that is slightly less than the distance between the central side wall portions 52A and 52B of the bottom 16. Accordingly, the floor 64 of the one-piece liner 18 mates with the floor 30 of the bottom 16 when the one-piece liner 18 is inserted into the bottom 16.

One edge of the rectangular end wall 60A adjoins the floor 64 along end line 66A. One edge of the rectangular end wall 60B adjoins the floor 64 along end line 66B. The end walls 60A and 60B have a width that is slightly less than the distance between the multilayered regions of the bottom side walls 38A and 38B. Accordingly, and as illustrated in FIG. 3, the width of the end walls 60A and 60B is less than the width of the floor 64. More specifically, the ends of the end walls 60A and 60B are inwardly spaced a distance A from the side lines 68A and 68B. The distance A is substantially equal to the thickness of an inwardly folded triangular section 44, 46, 48, and 50. Thus, the distance A is substantially equal to the thickness of two layers of sheet 28. Accordingly, when the one-piece insulating liner 18 is inserted into the bottom 16, the end walls 60A and 60B of the one-piece insulating liner 18 mate with the end walls 40A and 40B of the bottom 16.

As will become better understood from the following discussion, the trapezoidal side walls 62A and 62B are sized and shaped such that they mate with the central side wall portions 52A and 52B of the bottom 16. In accordance with the preferred embodiment of the present invention, each side wall 62A and 62B is a regular trapezoid having inclined sides of equal length. A larger one of the two parallel sides of the trapezoidal side wall 62A adjoins the floor 64 along side line 68A and has a length substantially equal to the length of the floor 64. Likewise, a larger one of the two parallel sides of the trapezoidal side wall 62B adjoins the floor 64 along side line 68B and also has a length substantially equal to the length of the floor 64.

The angles of the inclined sides of the trapezoidal side walls 62A and 62B are substantially equal to one another and to the corresponding angles of the inclined sides of the central side wall portions 52A and 52B. This means, as representatively illustrated in FIG. 1, that the angle, designated $\theta_1$, between one of the inclined sides and the longer one of the parallel sides of the trapezoidal side wall 62B is substantially equal to the angle, designated $\theta_2$, between one of the inclined sides and a larger one of the parallel sides of the central side wall portion 52B. As a result, the trapezoidal side walls 62A and 62B mate with the central side wall portions 52A and 52B when the one-piece insulating liner 18 is inserted into the bottom 16.

After the sheet 58 has been cut to form the integral shape described above, creases are made along end lines 66A and 66B and side lines 68A and 68B. The creases may be made with a hand tool or, preferably, with a machine, such as a press. The creases greatly assist folding the various sections of the sheet 58 upwardly to form the end walls 60A and 60B and side walls 62A and 62B. Alternatively, the end and side walls 60A, 60B, 62A, and 62B and creases may be created in one step by placing a rectangular sheet of foam insulating material in a press or other suitable machine that simultaneously cuts the outline of the sheet and makes a compression fold along each of the end and side lines 66A, 66B and 68A and 68B.

Figure 4:
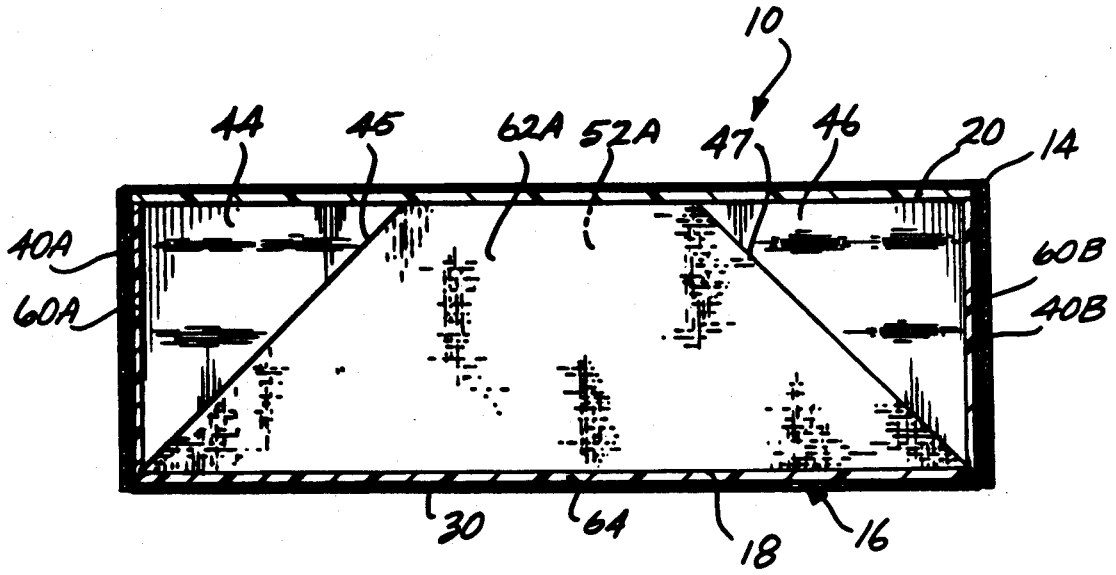

FIG. 4 is a side sectional view of the assembled insulated container system 10 illustrating several important features of the present invention. As discussed above, the one-piece insulating liner 18 mates with the single layered portions of the bottom 16. As illustrated in FIG. 4, the floor 64 and the end walls 60A and 60B of the one-piece liner 18 mate with the floor 64 and the end walls 40A and 40B of the bottom 16, respectively. Furthermore, the trapezoidal side walls 62A and 62B of the one-piece insulating liner 18 mate with the central side wall portions 52A and 52B of the bottom 16 (side wall 62B and central side wall portion 52B are not shown in FIG. 4).

As illustrated in FIG. 4, the inclined sides of the trapezoidal side wall 62A abut the inclined sides 45 and 47 of the inwardly folded sections 44 and 46 of the bottom 16. Likewise, although not depicted in FIG. 4, the trapezoidal side wall 62B abuts the inclined sides 49 and 51 of the inwardly folded sections 48 and 50. If the inwardly folded sections 44, 46, 48 and 50 are not triangular but are some other shape, the side walls 62A and 62B of the one-piece insulating liner 18 may be cut to the appropriate shape so that they will mate with the single layered portions of the side walls 38A and 38B of the bottom 16. If the bottom 16 is formed without inwardly folded sections 44, 46, 48 and 50, such that the side walls 38A and 38B do not have multilayered regions, the side walls 62A and 62B of the one-piece insulating liner 18 would be rectangular. In any event, the side walls 62A and 62B of the one-piece insulating liner 18 may be cut into an appropriate shape so that they mate with the single layered portions of the side walls 38A and 38B of the bottom 16.

As further illustrated in FIG. 4, the insulating lid 20 rests atop the end walls 60A and 60B and side walls 62A and 62B of the liner 18 when it is inserted into the container assembly. The combined height of the one-piece insulating liner 18 and the insulating lid 20 is substantially equal to the inside height of the bottom 16. When the top 14 is placed over the assembly, the insulating lid 20 mates with the ceiling of the top 14.

The rectangular corrugated cardboard sheets 28 used to form the bottom 16 (and top 14) can be stored flat until they are needed to assemble a telescoping container for the insulated container system 10. Likewise, creased and configuration-cut polystyrene or other foam insulating material sheets can be stored flat until needed to form a one-piece insulating liner 18. Accordingly, the components used with the insulated container system 10 of the present invention require very little storage space, and certainly much less space than containers that must be stored in an assembled, or partially assembled, condition.

Although typically the outer container will be telescoping and gusseted in which case the insulating liner will be rectangular with side walls normally trapezoidal so as to fit within the gussets, other forms of telescoping outer containers may be utilized which are not gusseted. In this case the insulating liner would not in any respect be trapezoidal, but would have square corners so as to join in covering the entire inside dimensions of the telescoping container bottom.

As can be readily appreciated from the foregoing description, the invention provides an insulated container system suitable for shipping perishable products. The system features a telescoping container, a one-piece insulating liner, and a separate insulating lid. While a preferred embodiment of the invention has been illustrated and described herein, it is to be understood that, within the scope of the appended claims, various changes can be made. For example, the telescoping container may be made from a material other than corrugated cardboard and the insulated liner and lid may be formed from an insulating material other than expanded polystyrene. The inwardly folded sections of the bottom of the telescoping container may be fastened to the end walls of the telescoping container instead of the side walls. Accordingly, the end walls of the one-piece liner may be trapezoidal while the side walls are rectangular. Furthermore, the side or end walls of the one piece liner may have a shape other than a regular trapezoid or rectangle in order to mate with the single layered portions of the bottom. If the top and bottom of the telescoping container have more than two end and side walls, the insulating liner may also have more than two end and side walls. Hence, within the scope of the appended claims it is to be understood that the invention can be practiced otherwise than as specifically described herein.

The embodiments of the invention in which an exclusive property or privilege is claimed are defined as follows:

1. An insulated container system for shipping perishable products comprising:

(a) an outer container having a top and a bottom, each of said top and said bottom comprising a rectangular sheet of container material, said rectangular sheets of container material folded such that said top has a substantially rectangular ceiling and said bottom has a substantially rectangular floor, such that said ceiling and said floor are encompassed by side walls and end walls and such that said top and said bottom have regions composed of a single layer of said container material, said top and said bottom having corners formed by inwardly folded sections of said rectangular sheets, said inwardly folded sections being fastened to single layered portions of said top and said bottom thereby forming multilayered regions;

(b) a one-piece insulating liner formed of an unbacked, separate single sheet of foam insulating material for covering said single layered regions of said bottom of said outer container when said one-piece insulating liner is inserted into said bottom but not said multilayered regions, said one-piece insulating liner comprising:

(i) a rectangular floor region;

(ii) two side wall regions; and, (iii) two end wall regions, said two side wall regions and said two end wall regions being unitarily joined together with said floor region such that said two side wall regions and said two end wall regions form an integral structure with said floor region, said one-piece insulating liner including compression creases where said two side wall regions and said two end wall regions join said floor region; and, (c) an insulating lid formed of a single sheet of foam insulating material for covering said ceiling of said top of said outer container when said insulating lid is inserted into said top.

2. The insulated container system claimed in claim 1, wherein said multilayered regions of said top and bottom are triangular.

3. The insulated container system claimed in claim 1, wherein said inwardly folded sections are fastened to said side walls of said top and said bottom.

4. The insulated container system claimed in claim 3, wherein said multilayered regions of said top and bottom are triangular.

5. The insulated container system claimed in claim 4, wherein said side walls of said top and bottom have single layered center side wall portions located between said multilayered regions.

6. The insulated container system claimed in claim 5, wherein said single layered center side wall portions of said side walls are trapezoidal.

7. The insulated container system claimed in claim 6, wherein said container material is a single layer of corrugated cardboard.

8. The insulated container system claimed in claim 7, wherein said single layer of corrugated cardboard is coated with a moisture repellant substance.

9. The insulated container system claimed in claim 1, wherein said foam insulating material is expanded polystyrene.

10. The insulated container claimed in claim 9, wherein said expanded polystyrene has a density falling in the range of 1.5–2.0 pounds per cubic foot.

11. An insulated container system for shipping perishable products comprising:

(a) a telescoping container constructed of corrugated cardboard, said container having a floor, a ceiling, side walls and end walls, predetermined regions of said floor, ceiling, side walls and end walls composed of a single layer of said corrugated cardboard, said telescoping container having a top and a bottom, each of said top and said bottom comprising a sheet of container material, said sheets of container material folded such that said top has a ceiling and said bottom has a floor, such that said ceiling and said floor are encompassed by walls and such that said top and said bottom have regions composed of a single layer of said container material, said top and said bottom having corners formed by inwardly folded sections of said sheets, said inwardly folded sections being fastened to single layered portions of said top and said bottom thereby forming multilayered regions;

(b) a one-piece insulating liner formed of an unbacked, separate single sheet of foam insulating material for covering said single layered predetermined regions of said floor and said walls of said telescoping container when said one-piece insulating liner is inserted into said telescoping container, said one-piece insulating layer comprising:

(i) a floor region; and (ii) a plurality of wall regions unitarily joined together with said floor region such that said wall regions form an integral structure with said floor region, said one-piece insulating liner including compression creases where said wall regions join said floor region; and, (c) an insulating lid formed of a single sheet of foam insulating material for covering said ceiling of said telescoping container when said insulating lid is located in said telescoping container.

12. The insulated container system claimed in claim 11, wherein said foam insulating material is expanded polystyrene.

13. The insulated container system claimed in claim 12, wherein said expanded polystyrene has a density falling in the range of 1.5–2.0 pounds per cubic foot.

14. The insulated container system claimed in claim 11, wherein said floor of said one-piece insulating liner is rectangular, said plurality of side walls comprising two quadrilateral side walls adjacent opposite sides of said rectangular floor and said plurality of end walls comprising two quadrilateral end walls adjacent opposite side of said rectangular floor, such that said two quadrilateral end walls are substantially perpendicular to said two quadrilateral side walls.

15. The insulated container system claimed in claim 14, wherein said two quadrilateral side walls are trapezoidal and said two quadrilateral end walls are rectangular.

16. The insulated container system claimed in claim 15, wherein said foam insulating material is expanded polystyrene.

17. The insulated container system claimed in claim 16, wherein said expanded polystyrene has a density falling in the range of 1.5–2.0 pounds per cubic foot.

* * * * *

UNITED STATES PATENT AND TRADEMARK OFFICE

CERTIFICATE OF CORRECTION

PATENT NO. : 5,009,326

DATED : April 23, 1991

INVENTOR(S) : Thomas A. Reaves et al.

It is certified that error appears in the above-identified patent and that said Letters Patent is hereby corrected as shown below:

| COLUMN | LINE | |
|---|---|---|
| 4 | 63 | Delete "5/8 inch" and insert therefor --3/8 inch-- |

Signed and Sealed this

Twenty-second Day of December, 1992

*Attest:*

DOUGLAS B. COMER

*Attesting Officer*

*Acting Commissioner of Patents and Trademarks*